United States Patent [19]

Chang

[11] Patent Number: 5,017,166

[45] Date of Patent: May 21, 1991

[54] POWER-DRIVEN SURFBOARD

[76] Inventor: Pao-Yuan Chang, No. 66, Alley 228, Wen Chang St., Nan Tun Area, Taichung, Taiwan

[21] Appl. No.: 559,919

[22] Filed: Jul. 30, 1990

[51] Int. Cl.[5] ..... A63C 15/04

[52] U.S. Cl. ..... 440/7; 440/6; 441/74

[58] Field of Search ..... 441/65, 74; 440/1, 6, 440/7, 49, 71, 72, 75, 76, 78, 83; 272/1 B, 33 R, 32, 33 A

[56] References Cited

U.S. PATENT DOCUMENTS

| | | | |
|---|---|---|---|
| 3,598,947 | 8/1971 | Osborn | 440/7 |
| 3,995,579 | 12/1976 | Childre | 440/7 |
| 4,020,782 | 5/1977 | Gleason | 441/74 |
| 4,130,079 | 12/1978 | Rhorer | 440/7 |
| 4,527,983 | 7/1985 | Booth | 440/7 |
| 4,537,144 | 8/1985 | Horton | 440/7 |
| 4,587,388 | 5/1986 | Cavin | 440/7 |
| 4,614,900 | 9/1986 | Young | 440/7 |
| 4,728,307 | 3/1988 | Burgess | 440/7 |

FOREIGN PATENT DOCUMENTS

| | | | |
|---|---|---|---|
| 2533234 | 2/1977 | Fed. Rep. of Germany | 440/7 |

*Primary Examiner*—Joseph F. Peters, Jr.
*Assistant Examiner*—Clifford T. Bartz
*Attorney, Agent, or Firm*—Varndell Legal Group

[57] ABSTRACT

A power-driven surfboard, whch comprises a DC power supply connected between a motor and a pressure-controlled power switch, which is controlled by a pressure board mounted on the top face thereof to drive the motor to operate, and a propeller connected to the motor through a transmission shaft. Once the pressure board is stepped on, the DC power supply is connected to provide the motor with necessary working voltage so as to drive the propeller to propel the surfboard to move forward on water surface.

1 Claim, 3 Drawing Sheets

POWER-DRIVEN SURFBOARD

BACKGROUND OF THE INVENTION

The present invention relates to surfboards, and more particularly to a power-driven surfboard for use in the sport of surfing.

Surfing is the sport of riding a surfboard on the crest of a wave to move toward shore. Therefore, the sport of surfing can only be played in seaside or where sea wave or artificial sea wave is available. The present invention is designed to provide a surfboard which can be used for playing the sport of surfing on smooth water surface.

SUMMARY OF THE INVENTION

The main object of the present invention is to provide a power-driven surfboard which can be used for playing the sport of surfing on the crest of a wave of water as well as on the smooth surface of peaceful water.

According to the present invention, a surfboard comprises a motor having and end connected to a DC power supply, which is controlled by a pressure-controlled power switch, and an opposite end connected with a propeller through a transmission shaft. Once the power switch is stepped on, the motor drives the transmission shaft to carry the propeller to operate so as to propel the surfboard to move forward on water surface by the backward thrust of water.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
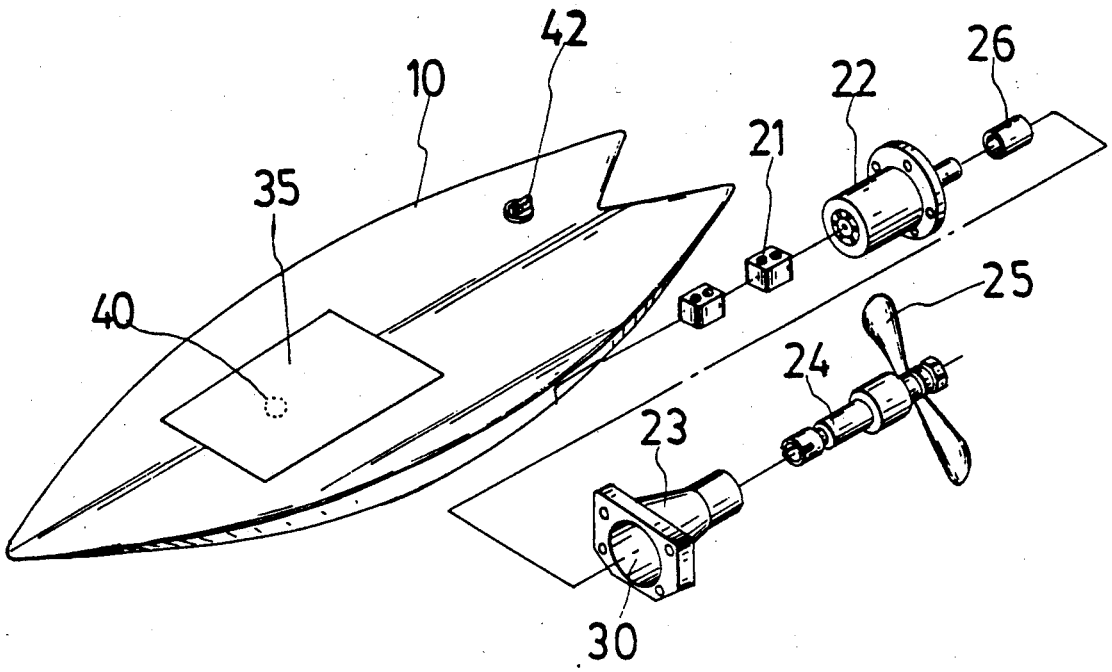
FIG. 1 is a perspective dismantled view of the preferred embodiment of the present invention.
Figure 2:
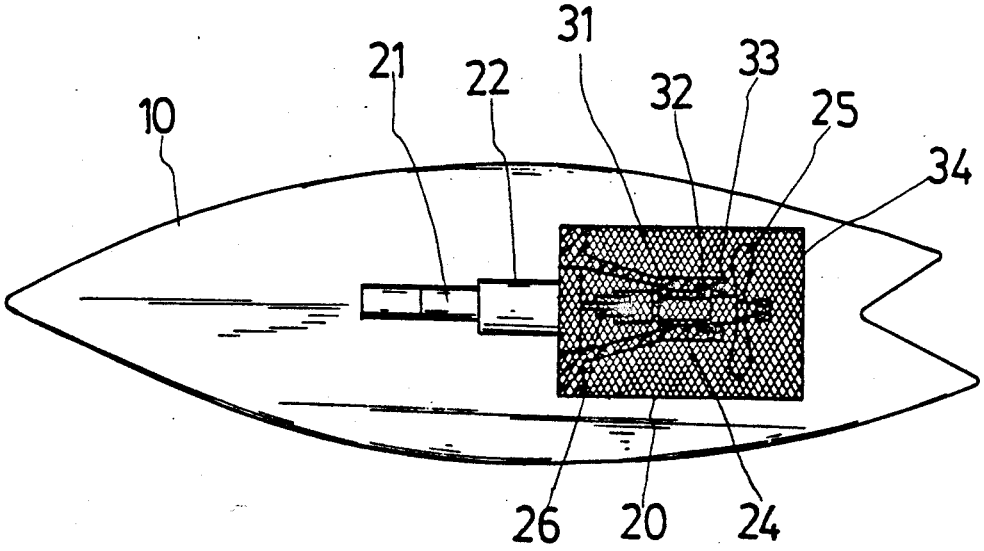
FIG. 2 a schematic bottom view of the preferred embodiment of the present invention.
Figure 3:
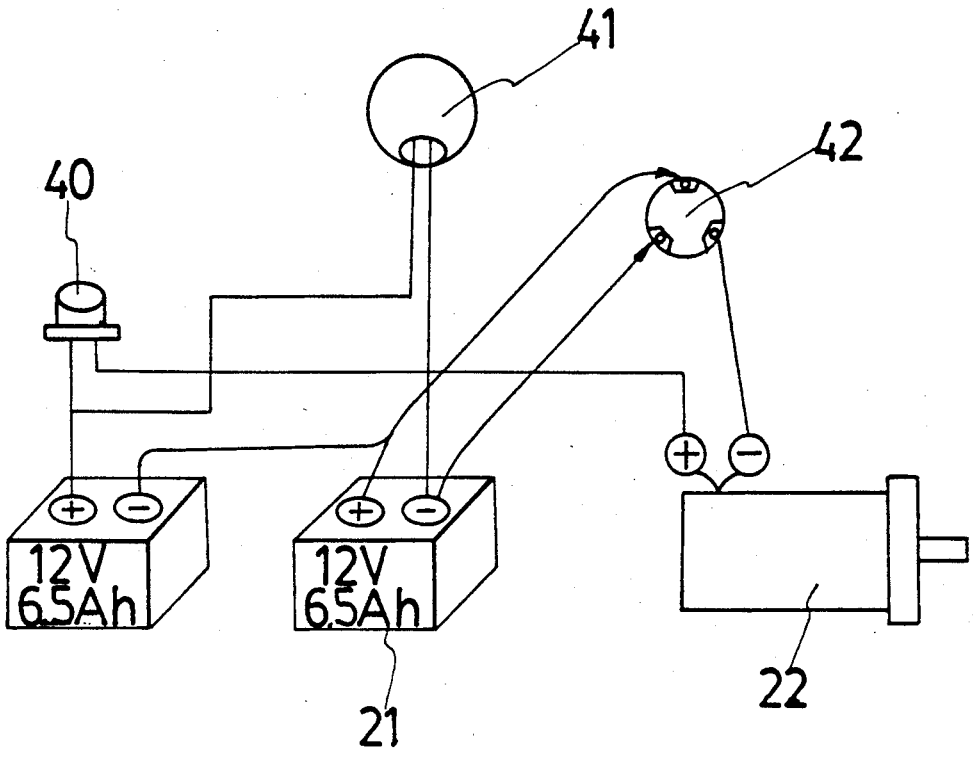
FIG. 3 is a schematic drawing illustrating the power control mechanism of the present invention.
Figure 4:
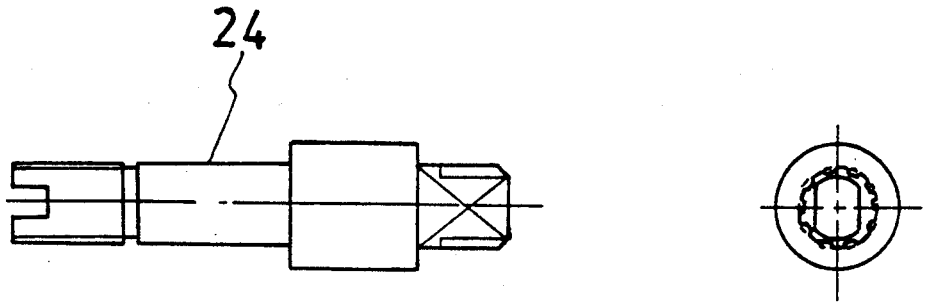
FIG. 4 illustrates the structure of the transmission shaft.
Figure 5:
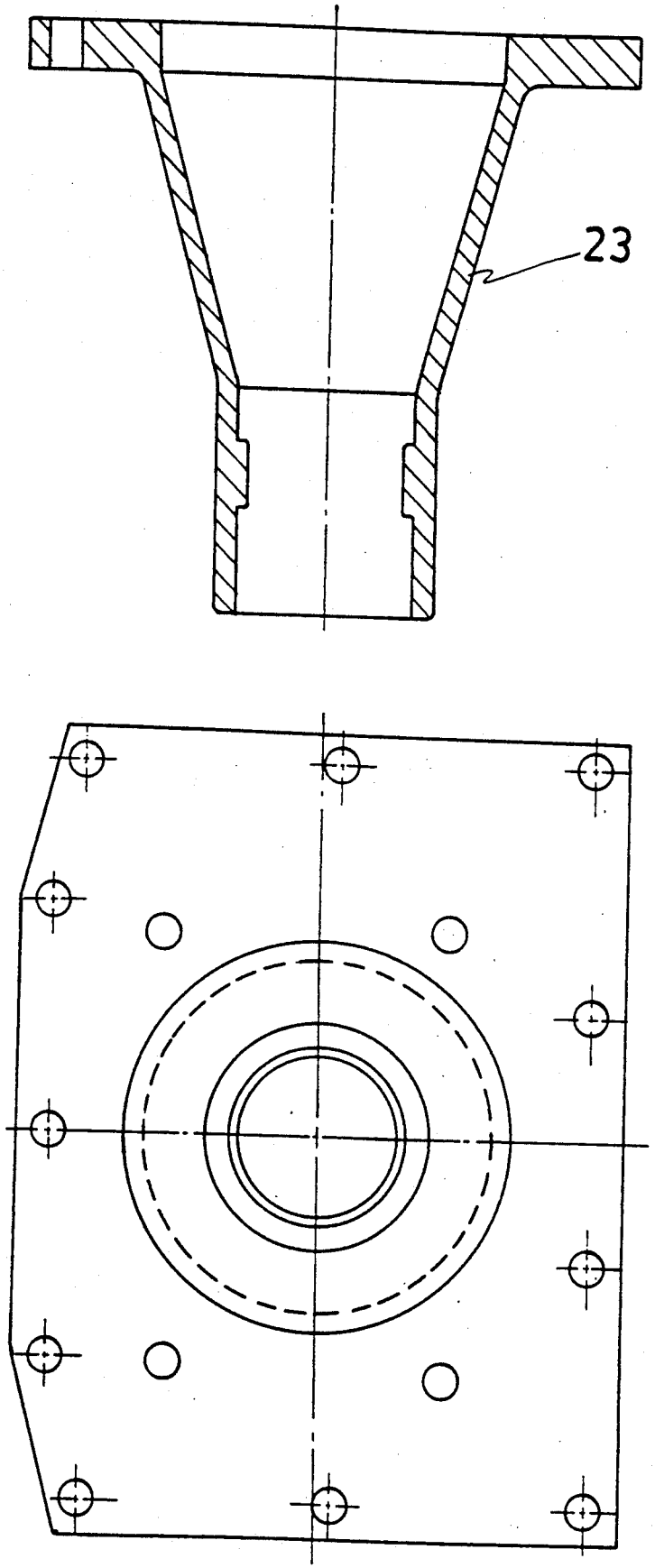
FIG. 5 illustrates the structure of the propeller holder.

Referring to the annexed drawings of FIGS. 1-5, therein illustrated is a surfboard 10 embodying the present invention, which comprises a recessed hole 20 on the bottom for mounting a propeller holder 23 to hold a propeller 25, and defines therein a hollow chamber (not shown) for holding a motor 22 and a DC power supply or battery 21. The hollow chamber is isolated from the recessed hole 20. The propeller holder 23 has an unitary conical portion at the middle and defines therein a bore 30. The motor 22 has a motor shaft inserted through the division wall between the hollow chamber and the recessed hole 20 into the bore 30 of the propeller holder 23 to couple with a transmission shaft 24 through a tube coupling 26. The transmission shaft 24 has its one end connected to the motor shaft of the motor 22 through the tube coupling 26 and its opposite end coupled with the propeller. Two bearings 31, 32 are fastened between the transmission shaft 24 and the bore 30 of the propeller holder 23 permitting the transmission shaft 24 to be driven to rotate smoothly by the motor 22. An oil seal 33 is fastened in the propeller holder 23 to seal the bore 30 at one end. A wire gauge guard 34 is covered on the recessed hole 20 to protect the propeller holder 23, the transmission shaft 24 and the propeller 25. There is a pressure board 35 mounted on the top face of the surfboard 10 with a power switch 40 fastened therein, which power switch 40 is connected in series between the DC power supply 21 and the motor 22 to control power supply from the DC power supply 21 to the motor 22.

Once the pressure board 35 is stepped on, the power switch 40 is immediately triggered to turn on the motor 22 so as to drive the propeller 25 to rotate via the transmission shaft 24. During operation of the propeller 25, the surfboard 10 is automatically propelled to move forward on water by the backward thrust of water.

The DC power supply 21 of the present invention provides the motor 22 with necessary working voltage, which can be a dry battery or rechargeable battery. If a rechargeable battery is used, an electric charger 41 may be used for charging electrically. There may be provided a propeller speed control switch 42 separately connected between the DC power supply 21 and the motor 22 to control the propeller speed by controlling the revolving speed of the motor 22.

Because of the self-provided and power-driven propeller, a surfboard according to the present invention can be used for riding on the crest of a wave as well as the surface of a smooth water. Once pressure force or one's foot is released from the pressure board 35, the power switch 40 is immediately switched off to stop the operation of the motor 22 and the propeller 25.

I claim:

1. A power-driven surfboard comprising a recessed hole on the bottom, said hole covered with a wire guard for mounting therein a propeller holder to hold a propeller, a separate hollow chamber for holding a motor and a DC power supply, said motor having a motor shaft inserted through the division wall between said hollow chamber and said recessed hole into the bore of said propeller holder to couple with a transmission shaft through a tube coupling, said transmission shaft being inserted through two bearings fastened inside said bore of said propeller holder and having an end coupled with said propeller, said bore of said propeller holder being sealed with an oil seal at each of its two opposite ends, and a pressure board mounted on the top face of said surfboard with a pressure-controlled power switch attached at the bottom of said pressure board said power switch being connected in series between said DC power supply and said motor to control the operation of said propeller when said pressure board is stepped on.

* * * * *